US009617996B2

(12) United States Patent
Toyama et al.

(10) Patent No.: US 9,617,996 B2
(45) Date of Patent: Apr. 11, 2017

(54) COMPRESSOR

(71) Applicant: DAIKIN INDUSTRIES, LTD., Osaka-shi, Osaka (JP)

(72) Inventors: Toshiyuki Toyama, Sakai (JP); Tsuyoshi Fukunaga, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 273 days.

(21) Appl. No.: 14/377,124

(22) PCT Filed: Feb. 8, 2013

(86) PCT No.: PCT/JP2013/000714
§ 371 (c)(1),
(2) Date: Aug. 6, 2014

(87) PCT Pub. No.: WO2013/118514
PCT Pub. Date: Aug. 15, 2013

(65) Prior Publication Data

US 2015/0030487 A1 Jan. 29, 2015

(30) Foreign Application Priority Data

Feb. 9, 2012 (JP) ..... 2012-026179
Jun. 8, 2012 (JP) ..... 2012-130671

(51) Int. Cl.
*F01C 21/04* (2006.01)
*F04C 29/02* (2006.01)
(Continued)

(52) U.S. Cl.
CPC ..... *F04C 18/02* (2013.01); *F04B 39/0246* (2013.01); *F04B 39/0261* (2013.01);
(Continued)

(58) Field of Classification Search
CPC ... F04B 39/0246; F04B 39/0261; F04C 29/02
(Continued)

(56) References Cited

U.S. PATENT DOCUMENTS 3,162,129 A * 12/1964 Erikson ..... F04C 11/001 418/15
6,135,738 A * 10/2000 Kajiwara ..... F04C 18/0215 418/188

FOREIGN PATENT DOCUMENTS

JP 2002-349460 A 12/2002
JP 2005-48689 A 2/2005
(Continued)

OTHER PUBLICATIONS

International Preliminary Report of corresponding PCT Application No. PCT/JP2013/000714 dated Aug. 12, 2014.
(Continued)

*Primary Examiner* — Deming Wan
(74) *Attorney, Agent, or Firm* — Global IP Counselors, LLP

(57) ABSTRACT

A compressor includes a casing, a motor fixed to the casing, a vertically extending drive shaft coupled to the motor, and a compression mechanism driven by the drive shaft to compress a fluid. A shaft-inside oil supply path is provided in the drive shaft. Oil at a bottom of the casing is supplied through the shaft-inside oil supply path to a sliding portion of the drive shaft above the motor. The compressor includes a shaft-inside oil discharge path provided in the drive shaft, and an oil discharge coupled to a lower end of the drive shaft. The shaft-inside oil discharge path extends from an upper portion to a lower portion of the motor. The oil discharge pump discharges the oil that has been supplied to the sliding portion of the drive shaft to the bottom of the casing through the shaft-inside oil discharge path.

4 Claims, 9 Drawing Sheets

(51) Int. Cl.

| | |
|---|---|
| ***F01C 1/063*** | (2006.01) |
| ***F03C 2/02*** | (2006.01) |
| ***F04C 2/02*** | (2006.01) |
| ***F04C 18/02*** | (2006.01) |
| ***F04C 23/00*** | (2006.01) |
| ***F04B 39/02*** | (2006.01) |

(52) U.S. Cl.
CPC ..... *F04C 18/0215* (2013.01); *F04C 23/008* (2013.01); *F04C 29/02* (2013.01); *F04C 29/025* (2013.01)

(58) Field of Classification Search
USPC ..... 418/88, 9, 94, 55.6, 270, DIG. 1, 418/55.1–55.5, 57
See application file for complete search history.

(56) References Cited

FOREIGN PATENT DOCUMENTS

| | | | |
|---|---|---|---|
| JP | 2009-127614 | A | 6/2009 |
| JP | 2010-285930 | A | 12/2010 |

OTHER PUBLICATIONS

International Search Report of corresponding PCT Application No. PCT/JP2013/000714 dated May 14, 2013.

* cited by examiner

COMPRESSOR

CROSS-REFERENCE TO RELATED APPLICATIONS

This U.S. National stage application claims priority under 35 U.S.C. §119(a) to Japanese Patent Application Nos. 2012-026179, filed in Japan on Feb. 9, 2012, and 2012-130671, filed in Japan on Jun. 6, 2012, the entire contents of which are hereby incorporated herein by reference.

TECHNICAL FIELD

The present invention relates to compressors which compresses a refrigerant, and specifically relates to methods for avoiding a reduction in motor efficiency.

BACKGROUND ART

Compressors which compress a refrigerant have been known. Japanese Unexamined Patent Publication No. 2010-285930 discloses a scroll compressor of this type.

In the compressor disclosed in Japanese Unexamined Patent Publication No. 2010-285930, a motor is fixed to an inner surface of a casing, and a drive shaft is coupled to the motor. A scroll-type compression mechanism is coupled to an upper portion of the drive shaft. In the compression mechanism, a movable scroll eccentrically rotates about a fixed scroll, and a refrigerant in a compression chamber is thereby compressed.

In this compressor, oil in an oil reservoir at the bottom of the casing is supplied to a pin bearing and an upper main bearing which are positioned above the motor, through an oil supply path in the drive shaft during a compression operation to lubricate the sliding portion thereof. After lubrication, the oil is discharged to the outside of the housing, and guided into a gap between the casing and a core cut formed in the outer circumferential surface of a stator of the motor via an oil return guide, and the oil drops from the lower end of the gap and is discharged into the oil reservoir.

SUMMARY

Technical Problem

However, in order to use the gap between the core cut of the motor and the casing as an oil return path as in Japanese Unexamined Patent Publication No. 2010-285930 , the stator needs to have a smaller cross-sectional area to keep the space for the path, and that may lead to a reduction in motor efficiency.

The present invention is thus intended to provide a compressor in which oil supplied to each sliding portion is reliably returned to an oil reservoir without reducing motor efficiency.

Solution to the Problem

The first aspect of the present invention is directed to a compressor that includes: a casing (20); a motor (30) fixed to the casing (20); a drive shaft (40) which is coupled to the motor (30) and extends vertically; a compression mechanism (50) which is driven by the drive shaft (40) and compresses a fluid; and a shaft-inside oil supply path (45) which is provided in the drive shaft (40) and through which oil at a bottom of the casing (20) is supplied to a sliding portion of the drive shaft (40) above the motor (30). The compressor includes a shaft-inside oil discharge path (46) which is provided in the drive shaft (40) and extends from an upper portion to a lower portion of the motor (30), and an oil discharge pump (81*b*) which is coupled to a lower end of the drive shaft (40) and discharges the oil having been supplied to the sliding portion of the drive shaft (40) to the bottom of the casing (20) through the shaft-inside oil discharge path (46).

In the first aspect of the present invention, the oil supplied to a sliding portion above the motor (30) is sucked into the shaft-inside oil discharge path (46) by the oil discharge pump (81*b*), and is transferred to a portion under the motor (30) through the shaft-inside oil discharge path (46), and is thereafter discharged to the bottom of the casing (20). Thus, unlike conventional cases, oil can be returned to the bottom of the casing (20) without passing through a gap between the core cut (34) of the motor (30) and the casing (20).

The second aspect of the present invention is that the compressor of the first aspect of the present invention includes an oil supply pump (81*a*) which supplies the oil at the bottom of the casing (20) to the shaft-inside oil supply path (45) and forms a double pump with the oil discharge pump (81*b*).

In the second aspect of the present invention, the oil supply pump (81*a*) is provided to form a double pump with the oil discharge pump (81*b*). Thus, the oil at the bottom of the casing (20) can be reliably supplied to the sliding portion through the shaft-inside oil supply path (45), and an oil supply/discharge system can be reduced in size.

The third aspect of the present invention is that in the second aspect of the present invention, the oil supply pump (81*a*) has a capacity that is larger than a capacity of the oil discharge pump (81*b*).

In the third aspect of the present invention, the capacity of the oil supply pump (81*a*) is larger than the capacity of the oil discharge pump (81*b*). Thus, oil discharge is not stopped, and a possibility that the refrigerant is sucked into the shaft-inside oil discharge path (46) is reduced.

The fourth aspect of the present invention is that the compressor of any one of the first to third aspects of the present invention includes: a lower bearing member (70) which rotatably supports a portion of the drive shaft (40) lower than the motor (30); and shaft-outside oil discharge paths (72, 73) which are formed in the lower bearing member (70) and communicate with an outlet end of the shaft-inside oil discharge path (46) and a suction port of the oil discharge pump (81*b*).

In the fourth aspect of the present invention, oil is supplied through the shaft-inside oil supply path (45) formed in the drive shaft (40), and the oil is discharged through the shaft-outside oil discharge paths 73) formed outside the drive shaft (40), under the motor (30). Therefore, arrangements of passages (45, 72, 73) around the oil discharge pump (81*b*) can be easily achieved.

Advantages of the Invention

According to the present invention, the oil having been supplied to a sliding portion above the motor (30) is sucked into the shaft-inside oil discharge path (46) by the oil discharge pump (81*b*), and thereafter, the oil is transferred to a portion under the motor (30) through the shaft-inside oil discharge path (46) and is discharged to the bottom of the casing (20). Thus, unlike conventional cases, oil can be returned to the bottom of the casing (20) without passing through a gap between the core cut (34) of the motor (30) and the casing (20). Therefore, the core cut (34) does not have to be large, and the cross-sectional area of the stator does not have to be reduced, in order to keep the space for the oil return path. As a result, a reduction in motor efficiency can be prevented.

According to the second aspect of the present invention, the oil supply pump (81*a*) for supplying oil from the bottom of the casing (20) to the shaft-inside oil supply path (45) is provided, and the oil supply pump (81*a*) and the oil discharge pump (81*b*) together form a double pump. Thus, the oil can be reliably supplied to the sliding portion, and the oil supply/discharge system can be reduced in size.

According to the third aspect of the present invention, the capacity of the oil supply pump (81*a*) is larger than the capacity of the oil discharge pump (81*b*). Due to this configuration, the oil supply amount can be larger than the oil discharge amount. This can prevent a situation where oil is not adequately supplied to the sliding portions of the bearings (the pin bearing (58), the main bearing (37), and the lower bearing (71)) and the refrigerant gas flows into the sliding portions. As a result, it is possible to reduce a reduction in lubricity at the sliding portions.

According to the fourth aspect of the present invention, the shaft-outside oil discharge paths (72, 73) are formed in the lower bearing member (70) Thus, the oil is supplied through the shaft-inside oil supply path (45) formed in the drive shaft (40), and the oil is discharged through the shaft-outside oil discharge paths (72, 73) formed outside the drive shaft (40), under the motor (30). Therefore, arrangements of the passages (45, 72, 73) around the oil discharge pump (81*b*) can be easily achieved.

DESCRIPTION OF EMBODIMENTS

<<First Embodiment of Invention>>

The first embodiment of the present invention will be described in detail below with reference to FIG. 1 to FIG. 3. A compressor (10) of the first embodiment of the present invention is a scroll compressor. The compressor (10) is connected to a refrigerant circuit of a refrigerating apparatus not shown. In the refrigerating apparatus, the refrigerant compressed by the compressor (10) dissipates heat in a condenser (a radiator), and is decompressed by a decompression mechanism. The decompressed refrigerant evaporates in an evaporator, and is sucked into the compressor (10). That is, the refrigerant circuit of the refrigerating apparatus performs a vapor compression refrigeration cycle by circulating the refrigerant.

Figure 1:
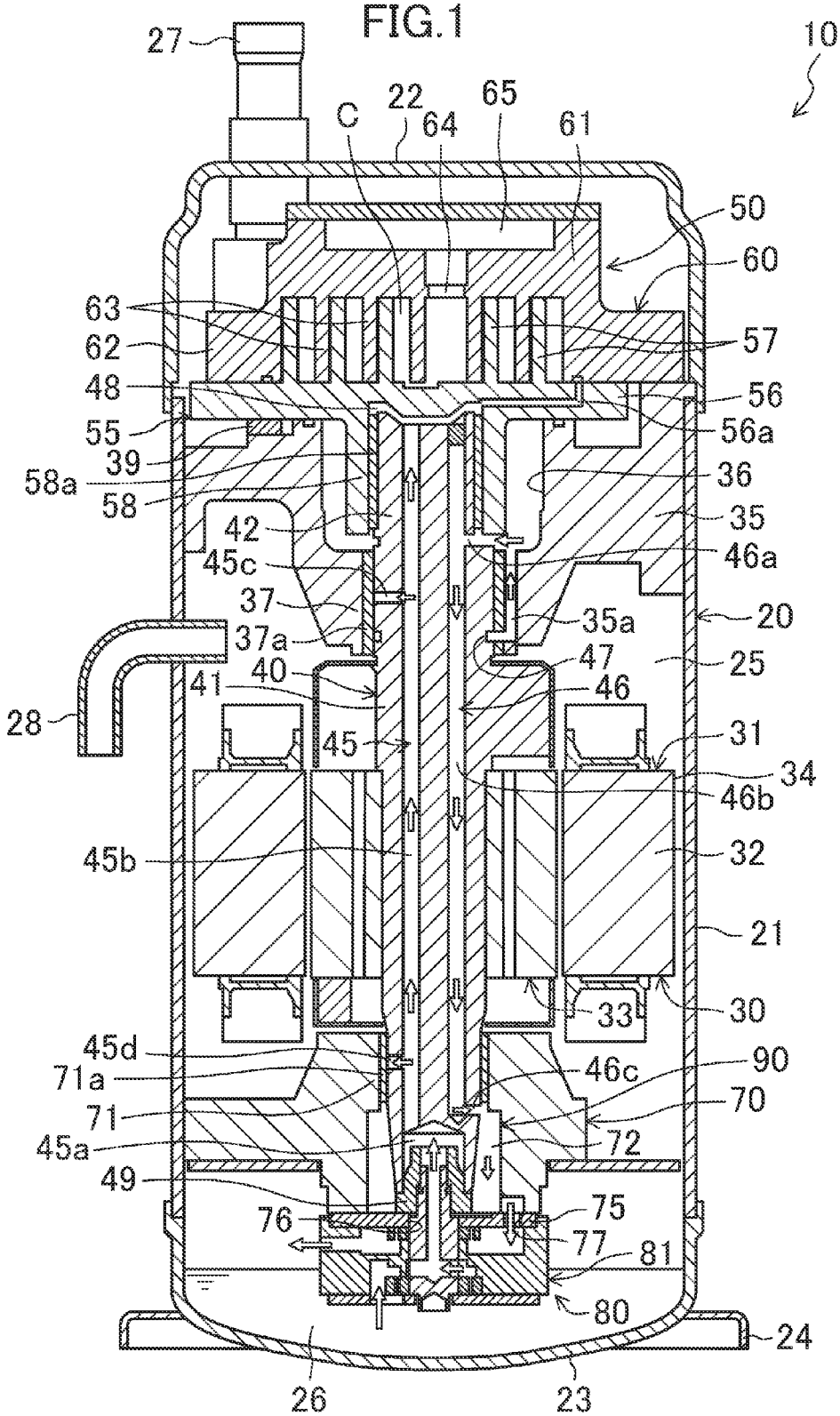
FIG. 1 is a longitudinal cross section of a compressor of the first embodiment, in which an oil flow is indicated by white arrows.

As shown in FIG. 1, the compressor (10) includes a casing (20), a motor (30), a drive shaft (40), and a compression mechanism (50).

The casing (20) is a hermetic container in a vertically-elongated, cylindrical shape. The casing (20) includes a cylindrical body (21) of which the both axial ends are open, a first end plate (22) which closes one of the axial ends (the upper end) of the body (21), and a second end plate (23) which closes the other axial end (the lower end) of the body (21). A leg portion (24) is provided under the second end plate (23) to support the casing (20).

The motor (30) includes a stator (31) fixed to an inner wall of the casing (20), and a rotator (33) inserted in the stator (31). The stator (31) includes an approximately cylindrical stator core (32), and a wire (not shown) wound around the stator core (32). The outer circumferential surface of the stator core (32) is fixed to an inner circumferential surface of the casing (20). A core cut (34) which penetrates the stator core (32) in an axial direction is formed in the outer circumferential surface of the stator core (32). The rotator (33) is in an approximately cylindrical shape, and the drive shaft (40) is inserted in the rotator (33) for connection.

The drive shaft (40) extends from an upper end of the body (21) of the casing (20) to a bottom portion of the casing (20) in the axial direction (the vertical direction) of the casing (20). An oil pump (81) is fixed to a lower end of the drive shaft (40). A shaft-inside oil supply path (45) and a shaft-inside oil discharge path (46) are formed in the drive shaft (40). The oil pump (81), the shaft-inside oil supply path (45), and the shaft-inside oil discharge path (46) will be described in detail later.

The compression mechanism (50) is driven by the drive shaft (40) and compresses a refrigerant (a low-pressure gas refrigerant) of the refrigerant circuit. The compression mechanism (50) includes a housing (35), a movable scroll (55), a fixed scroll (60), and a rotation preventing member (39).

The housing (35) is an approximately cylindrical, vertically extending member, with its outer circumferential surface joined to the inner circumferential surface of the body (21) of the casing (20). The drive shaft (40) is inserted in the housing (35), and a main bearing (37) is provided at a lower portion of the housing (35). A sliding bearing (37*a*) is fitted in the main bearing (37), and the sliding bearing (37*a*) rotatably supports a main shaft (41) of the drive shaft (40).

An approximately circular recess (36) when viewed in the axial direction is formed at an upper portion of the housing (35) by recessing the upper end surface of the housing (35). A pin shaft (42) of the drive shaft (40) protrudes upward from the upper end surface of the main shaft (41) and is accommodated in the recess (36). The pin shaft (42) is configured to have a diameter smaller than that of the main shaft (41) of the drive shaft (40). The pin shaft (42) is eccentric with respect to the main shaft (41) of the drive shaft (40).

The rotation preventing member (39) which prevents rotation of the movable scroll (55) is provided on the upper surface of the housing (35). The rotation preventing member (39) is Oldham coupling, for example. The rotation preventing member (39) is slidably fitted in a movable end plate (56) of the movable scroll (55) and the housing (35).

The movable scroll (55) includes the movable end plate (56), a movable lap (57), and a pin bearing (58). The movable end plate (56) is in a disc shape. The movable lap (57) is vertically arranged on one side (the upper side) of the movable end plate (56) in its thickness direction. The movable lap (57) is spiral-shaped. The tubular pin bearing (58) is provided on the other side (the lower side) of the movable end plate (56) at a central portion in a radial direction. The sliding bearing (58*a*) is fitted in the pin bearing (58) and rotatably supports the pin shaft (42).

The fixed scroll (60) includes a fixed end plate (61), an outer edge portion (62), and a fixed lap (63). The fixed end plate (61) is in a disc shape. The outer edge portion (62) and the fixed lap (63) are vertically arranged on a surface of the fixed end plate (61) facing the movable scroll (55).

The outer edge portion (62) is in a tubular shape and located at an outer peripheral end of the fixed scroll (60). One of end surfaces of the movable end plate (56) of the movable scroll (55) in the axial direction (the upper end surface in FIG. 1) is in sliding contact with one of end surfaces of the outer edge portion (62) in the axial direction (the lower end surface in FIG. 1), thereby forming a thrust surface. The fixed lap (63) is positioned in the outer edge portion (62), and is spiral-shaped. The fixed lap (63) engages with the movable lap (57).

In the compression mechanism (50), a compression chamber (C) configured to compress a refrigerant is formed between the movable scroll (55) and the fixed scroll (60). The fixed end plate (61) of the fixed scroll (60) is provided with a discharge port (64) and a discharge chamber (65). The discharge port (64) is formed at a central portion of the fixed end plate (61) in the radial direction, and communicates with the compression chamber (C). The discharge chamber (65) is connected to an outlet end of the discharge port (64). The discharge chamber (65) communicates with a space below the housing (35) in the casing (20) through a discharge passage (not shown). That is, the space below the housing (35) forms a high-pressure space (25) filled with a high-pressure refrigerant that has been discharged.

A suction pipe (27) and a discharge pipe (28) are connected to the casing (20) of the compressor (10). The suction pipe (27) is connected to a low-pressure gas line of the refrigerant circuit, and communicates with the compression chamber (C) through an auxiliary suction port (not shown). The discharge pipe (28) penetrates the body (21) of the casing (20) in a radial direction. The outlet end of the discharge pipe (28) is connected to a high-pressure gas line of the refrigerant circuit. The intake end of the discharge pipe (28) is open to a space between the housing (35) and the motor (30) in the high-pressure space (25). The oil contained in a high-pressure refrigerant in the high-pressure space (25) is accumulated in the bottom of the casing (20). That is, an oil reservoir (26) which accumulates oil for lubricating a respective sliding portion in the compressor (10) is formed in the bottom of the casing (20).

Figure 2:
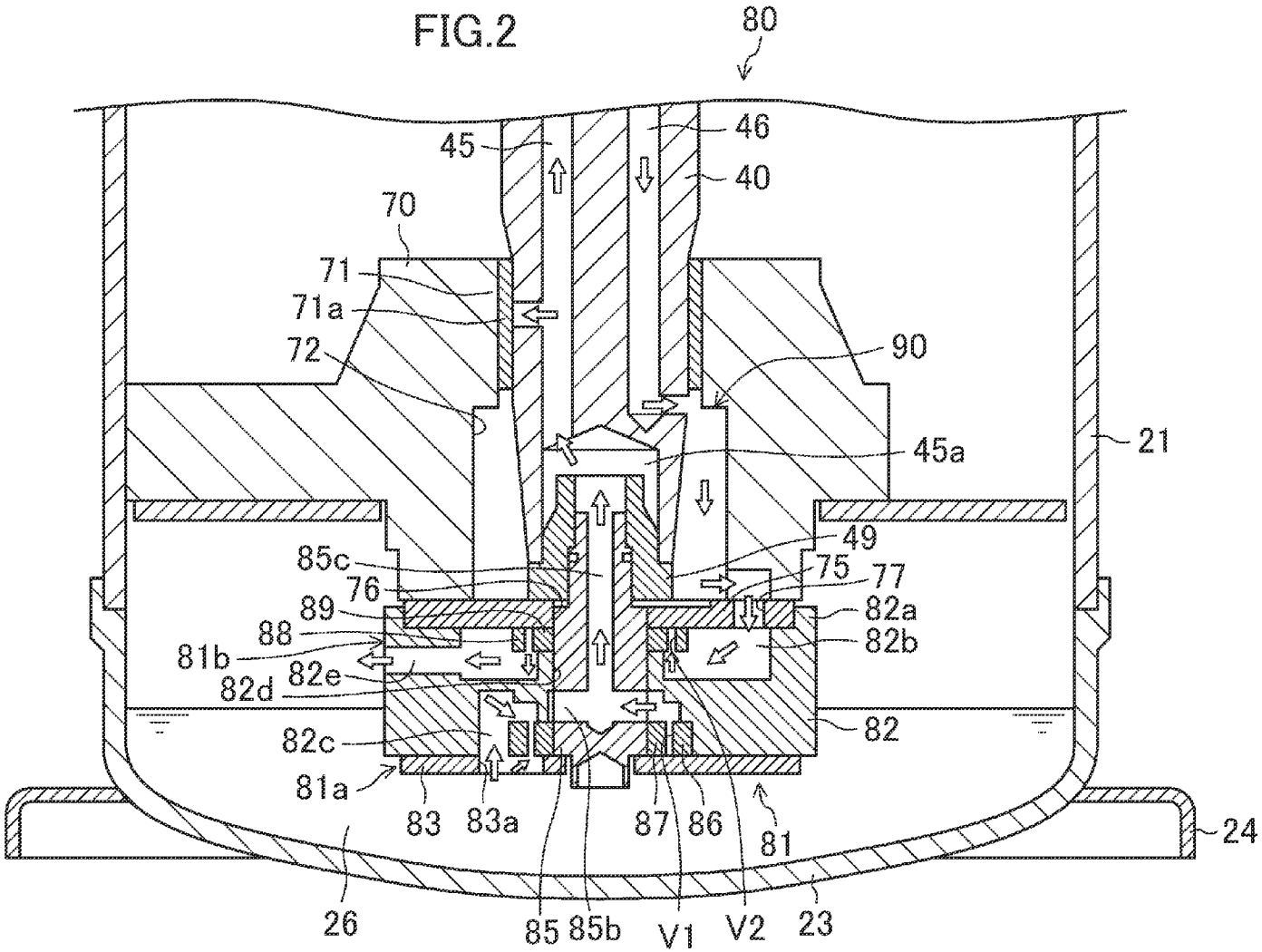
FIG. 2 is an enlarged view of an oil pump and its surroundings in the compressor of the first embodiment.
Figure 3:
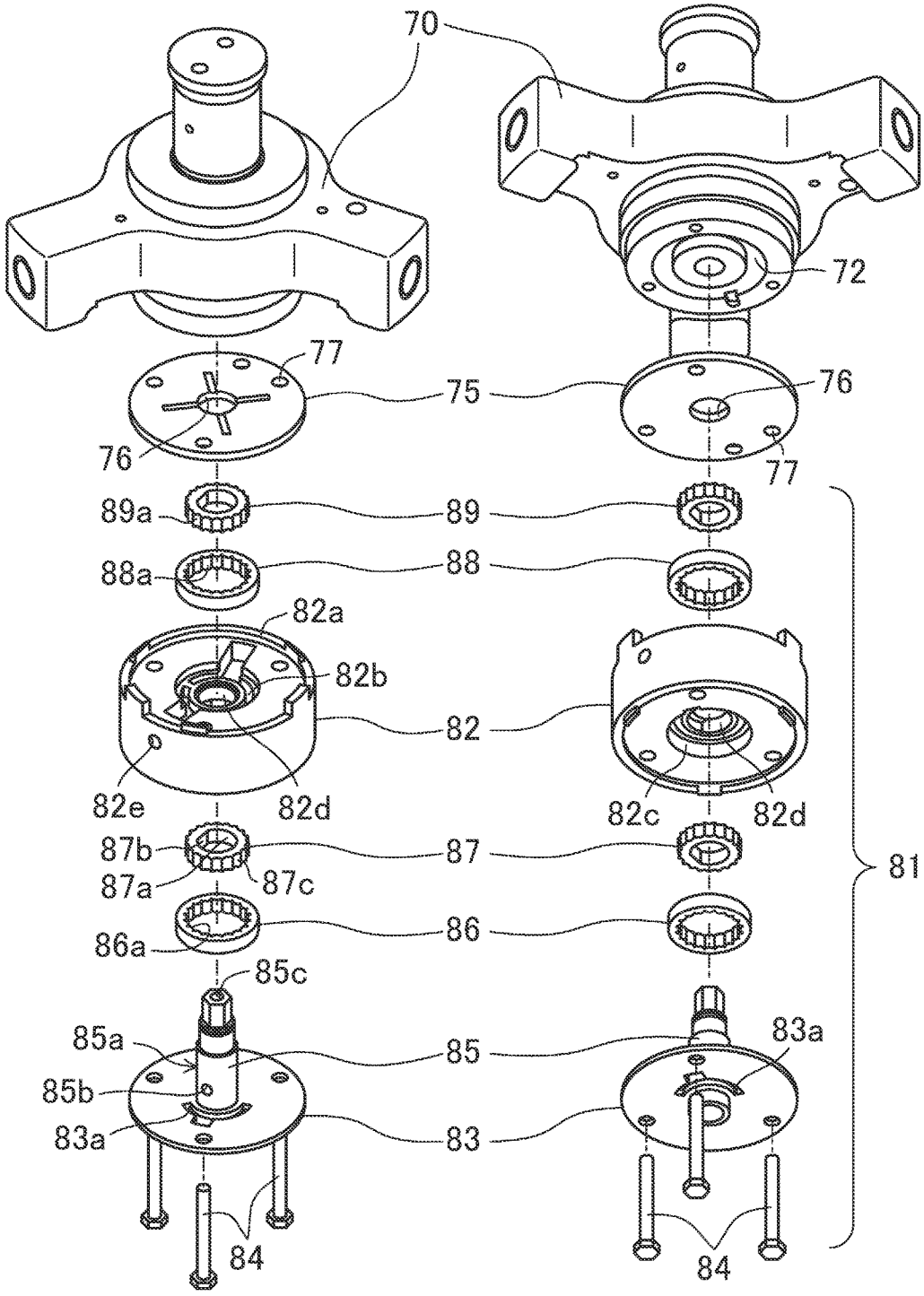
FIG. 3 is an exploded oblique view of the oil pump of the first embodiment.

As shown in FIG. 2, a lower bearing member (70) is provided near the oil reservoir (26) at the bottom of the casing (20). The lower bearing member (70) is a vertically extending, approximately cylindrical member, with its outer circumferential surface protruding outward and fixed to the inner circumferential surface of the casing (20). The drive shaft (40) is inserted in the lower bearing member (70), and a lower bearing (71) is formed at an upper portion of the lower bearing member (70). A sliding bearing (71*a*) is fitted in the lower bearing (71), and the sliding bearing (71*a*) rotatably supports the drive shaft (40).

An approximately circular recess (72) when viewed in the axial direction is formed at a lower portion of a lower bearing member (70) by recessing the lower end surface of the lower bearing member (70). The oil pump (81) is attached to the lower end surface of the lower bearing member (70) so as to close the recess (72).

<Oil Supply/Discharge Mechanism>

The compressor (10) of the present embodiment has an oil supply/discharge mechanism (80) which supplies the oil in the oil reservoir (26) to respective sliding portions of the drive shaft (40), and discharges the oil having being supplied to the respective sliding portions to the oil reservoir (26). The oil supply/discharge mechanism (80) includes the oil pump (81), the shaft-inside oil supply path (45), and the oil discharge path (90).

(Oil Pump)

The oil pump (81) is comprised of a so-called double trochoid type positive displacement pump. As shown in FIG. 2 and FIG. 3, the oil pump (81) is fixed to a lower end surface of the lower bearing member (70) with bolts (84), and includes a thrust plate (75), a pump case (82), a pump cover (83), a pump shaft (85), a lower outer rotor (86), a lower inner rotor (87), an upper outer rotor (88), and an upper inner rotor (89).

The thrust plate (75) is in an approximately disc shape, and comes in sliding contact with the drive shaft (40) and receives thrust force of the drive shaft (40). An insertion hole (76) to which the pump shaft (85) is inserted is formed at a central portion of the thrust plate (75) in the radial direction. Further, an exhaust port (77) for exhausting oil is formed at a peripheral portion of the thrust plate (75).

The pump case (82) is a vertically extending, approximately cylindrical member, and is provided with an upward projecting boundary edge (82*a*) on the upper surface. The pump case (82) is fixed to the lower surface of the thrust plate (75), with the thrust plate (75) fitted to an area surrounded by the boundary edge (82*a*). The pump case (82) is also provided with an upper case passage (82*b*) that is recessed in an approximately circular shape at an almost central portion of the upper surface of the pump case (82), and a lower case passage (82*c*) that is recessed in an approximately circular shape at an almost central portion of the lower surface of the pump case (82).

The pump cover (83) is in an approximately disc shape. The pump shaft (85) extending upward is rotatably supported at a central portion of the pump cover (83). The pump shaft (85) is inserted in an inner hole (82*d*) of the pump case (82) and the insertion hole (76) of the thrust plate (75) from the bottom, and in this insertion state, the pump cover (83) is fixed to the lower surface of the pump case (82).

The pump shaft (85) is coupled to an intake port (45*a*) provided at the lower end of the drive shaft (40) via a cylindrical holding member (49). Thus, the pump shaft (85) rotates integrally with the drive shaft (40).

The lower outer rotor (86) is fitted in the lower case passage (82*c*). The lower outer rotor (86) is in an approximately annular shape, and is provided with a plurality of approximately arc-shaped (more strictly, trochoid curve-shaped) outer teeth (86*a*) on the inner circumferential surface of the lower outer rotor (86). The plurality of outer teeth (86*a*) are equally spaced in a circumferential direction, and protrude toward the lower inner rotor (87).

The lower inner rotor (87) is in an approximately annular shape, and is fitted to the outer side of the pump shaft (85). Specifically, the lower inner rotor (87) has, at its inner portion, a holding hole (87*a*) having an approximately D-shaped cross section perpendicular to the axis. A flat wall (85*a*) of the pump shaft (85) is engaged with a flat surface (87*b*) of the holding hole (87*a*), and therefore, the lower inner rotor (87) rotates integrally with the pump shaft (85). The lower inner rotor (87) is provided, in the outer circumferential surface thereof, a plurality of inner teeth (87*c*) which correspond to the outer teeth (86*a*) of the lower outer rotor (86). That is, in the oil pump (81), the inner teeth (87*c*) and the outer teeth (86*a*) are meshed with each other, and a volume chamber (V1) for transferring oil is formed between the inner teeth (87*c*) and the outer teeth (86*a*).

The pump cover (83) is provided with a suction port (83*a*) having an approximately crescent shape and located radially outward from the pump shaft (85). An intake end of the suction port (83*a*) is open to the oil reservoir (26), and an outlet end of the suction port (83*a*) is open to the lower case passage (82*c*) of the pump case (82). Further, a radial direction transfer path (85*b*) and an axial direction transfer path (85*c*) are formed in the pump shaft (85). The radial direction transfer path (85*b*) penetrates the pump shaft (85) in the radial direction, with its intake end open to the lower case passage (82*c*) of the pump case (82). The axial direction transfer path (85*c*) penetrates an upper portion of the pump shaft (85) in the axial direction. The intake end of the axial direction transfer path (85*c*) communicates with the radial direction transfer path (85*b*), and the outlet end of the axial direction transfer path (85*c*) is open to an upper end surface of the pump shaft (85), and communicates with the shaft-inside oil supply path (45) in the drive shall (40).

A lower portion of the oil pump (81) forms an oil supply pump (81*a*). The oil in the oil reservoir (26) flows into the oil supply pump (81*a*) through the suction port (83*a*) of the pump cover (83). The oil passes through the volume chamber (V1) between the rotors (86, 87) in the lower case passage (82*c*) and then passes through the radial direction transfer path (85*b*) and the axial direction transfer path (85*c*) to be supplied to the shaft-inside oil supply path (45). The oil supply pump (81*a*) forms an oil supply pump of the present invention.

The upper outer rotor (88) is fitted in the upper case passage (82*b*). The upper outer rotor (88) has approximately the same shape as the lower outer rotor (86).

The upper inner rotor (89) is fitted to the outer surface of the pump shaft (85). The upper inner rotor (89) has approximately the same shape as the lower inner rotor (87). Inner teeth (89*a*) of the upper inner rotor (89) and outer teeth (88*a*) of the upper outer rotor (88) are meshed with each other, and a volume chamber (V2) for transmitting oil is formed between the inner teeth (89*a*) and the outer teeth (88*a*). The volume chamber (V1) between the two rotors (86, 87) on the lower side is larger than the volume chamber (V2) between the two rotors (88, 89) on the upper side.

An upper end (i.e., an intake end) of the exhaust port (77) of the thrust plate (75) is open to the recess (72) of the lower bearing member (70), and an lower end an outlet end) of the exhaust port (77) is open to the upper case passage (82*b*) of the pump case (82). The pump case (82) is provided with an exhaust path (82*e*) which penetrates the pump case (82) in a lateral direction to communicate between inside and outside of the pump case (82). An inner end (i.e., an intake end) of the exhaust path (82*e*) is open to the upper case passage (82*b*), and an outer end (i.e., an outlet end) of the exhaust path (82*e*) is open to the outer circumferential surface of the pump case (82).

An upper portion of the pump (81) forms an oil discharge pump (81*b*). In the oil discharge pump (81*b*), oil flows into the upper case passage (82*b*) from the recess (72) of the lower bearing member (70) which forms part of the oil discharge path (90) through the exhaust port (77) of the thrust plate (75). The oil passes through the volume chamber (V2) between the rotors (88, 89) in the upper case passage (82*b*), and then passes through the exhaust path (82*e*) to be discharged to the oil reservoir (26) at the bottom of the casing (20). The oil discharge pump (81*b*) forms an oil discharge pump of the present invention.

(Shaft-Inside Oil Supply Path)

The shaft-inside oil supply path (45) leads the oil in the oil reservoir (26) to the respective sliding portions of the drive shaft (40) through the oil supply pump (81*a*) of the oil pump (81). As shown in FIG. 1, the shaft-inside oil supply path (45) includes the intake port (45*a*), a main oil supply path (45*b*), an upper outlet port (45*c*), and a lower outlet port (45*d*).

The intake port (45*a*) communicates with the axial direction transfer path (85*c*) of the oil pump (81).

The main oil supply path (45*b*) communicates with the intake port (45*a*) and extends in the axial direction of the drive shaft (40), and is open at the upper end surface of the drive shaft (40) (i.e., the upper end surface of the pin shaft (42)).

The upper outlet port (45*c*) extends outward in the radial direction from the main oil supply path (45*b*) and is open to the main bearing (37) of the housing (35). The oil having flowed to the main bearing (37) through the upper outlet port (45*c*) is supplied to the sliding portion between the sliding bearing (37*a*) of the main bearing (37) and the drive shaft (40).

The lower outlet port (45*d*) extends outward in the radial direction from the main oil supply path (45*b*) and is open to the lower bearing (71) of the lower bearing member (70). The oil having flowed to the lower bearing (71) through the lower outlet port (45*d*) is supplied to the sliding portion between the sliding bearing (71*a*) of the lower bearing (71) and the drive shaft (40).

Further, an oil communication chamber (48) is formed between the upper end surface of the drive shaft (40) and the lower surface of the movable end plate (56). The oil communication chamber (48) communicates with the main oil supply path (45*b*) and a pin shaft passage (not shown) on the drive shaft (40) side, and communicates with an oil path (56*a*) on the movable end plate (56) side. The pin shaft passage extends vertically between the pin shaft (42) and the sliding bearing (58*a*) of the pin bearing (58), with its upper end open to the oil communication chamber (48) and its lower end open to the recess (36) of the housing (35). The oil having flowed to the pin shaft passage is supplied to the sliding portion between the sliding bearing (58*a*) of the pin bearing (58) and the drive shaft (40). The oil path (56*a*) is formed in the movable end plate (56), with its upper end open at the upper surface of the movable end plate (56) and its lower end open at the lower surface of the movable end plate (56), and communicates with the oil communication chamber (48).

(Oil Discharge Path)

The oil discharge path (90) leads the oil having been supplied to the respective sliding portions of the drive shaft (40) to the oil discharge (81*b*) of the oil pump (81). The oil discharge path (90) includes a main bearing oil discharge path (35*a*), the shaft-inside oil discharge path (46), and the recess (72) of the lower bearing member (70).

The train bearing oil discharge path (35*a*) leads the oil having been supplied to the sliding portion of the sliding bearing (37*a*) of the main bearing (37) to the recess (36) of the housing (35), and extends vertically along the sliding bearing (37*a*) in the housing (35). An intake end (i.e., the lower end) of the main bearing oil discharge path (35*a*) communicates with a circumferential groove (47) of the drive shaft (40) which is located at the lower end of the sliding bearing (37*a*). The outlet end (i.e., the upper end) of the main bearing oil discharge path (35*a*) is open to the recess (36).

The shaft-inside oil discharge path (46) leads the oil in the recess (36) in the housing (35) to the recess (72) in the lower bearing member (70) which is located under the motor (30). The oil in the recess (36) in the housing (35) is specifically the oil having flowed out of the main bearing oil discharge path (35*a*), and the oil having flowed out of the pin shaft passage. The shaft-inside oil discharge path (46) includes an intake port (46*a*), a main oil discharge path (46*b*), and an exhaust port (46*c*).

The intake end of the intake port (46*a*) is open to the recess (36) in the housing and the outlet end thereof communicates with the main oil discharge path (46*b*).

The main oil discharge path (46*b*) extends in the axial direction from the upper end surface of the drive shaft (40) (i.e., the upper end surface of the pin shaft (42)), and communicates with the intake port (46*a*) at a portion thereof. The upper end of the main oil discharge path (46*b*) is plugged.

The exhaust port (46*c*) extends in a lateral direction from the lower end of the main oil discharge path (46*b*), and is open to the recess (72) in the lower bearing member (70).

The recess (72) in the lower bearing member (70) leads the oil having flowed therein from the shaft-inside oil discharge path (46) to the exhaust port (77) formed in the thrust plate (75). The recess (72) forms a shaft-outside oil discharge path of the present invention.

—Operation—

A basic operation of the compressor (10) will be described with reference to FIG. 1. During an operation of the compressor (10), the motor (30) is powered to rotate the rotator (33). The drive shaft (40) is accordingly rotated, making the pin shaft (42) eccentrically rotate with respect to the main shaft (41). As a result, a compression operation is performed in the compression mechanism (50).

Specifically, in the compression mechanism (50), the movable scroll (55) does not rotate but revolve. Thus, a refrigerant (a low-pressure gas refrigerant) in the refrigerant circuit is sucked into the compression mechanism (50) from the suction pipe (27) by way of a low-pressure, space and an auxiliary suction port. The refrigerant is sucked into the compression mechanism (50) from a circumferential side of the fixed lap (63). When the movable scroll (55) further revolves, the compression chamber (C) that is a closed space is formed between the fixed lap (63) and the movable lap (57). The volume of the compression chamber (C) is gradually reduced as it comes closer to a central portion of the fixed scroll (60). The refrigerant is thus compressed in the compression chamber (C). When the compression chamber (C) communicates with the discharge port (64), the refrigerant in the compression chamber (C) is discharged from the discharge port (64) to the discharge chamber (65).

The refrigerant (i.e., the high-pressure gas refrigerant) discharged to the discharge chamber (65) is transferred to the high-pressure space (25) through a discharge passage (not shown). The refrigerant in the high-pressure space (25) is transferred to a refrigerant circuit outside the casing (20) through the discharge pipe (28).

<Oil Supply and Discharge Operation>

Now, the oil supply and discharge operation at the compressor (10) will be described with reference to FIG. 1 and FIG. 2. When the compressor (10) is operated, the drive shaft (40) is accordingly rotated as described above, and the oil pump (81) is also driven by the rotation of the drive shaft (40). In the oil pump (81), the lower inner rotor (87) shown in FIG. 2 rotates inside the lower outer rotor (86). The volume of the volume chamber (V1) is therefore increased and decreased, and the oil in the oil reservoir (26) is sucked into the oil supply pump (81*a*) of the oil pump (81).

Specifically, the oil in the oil reservoir (26) is sucked into the volume chamber (V1) in the lower case passage (82*c*) through the suction port (83*a*) of the pump cover (83). The oil in the volume chamber (V1) sequentially flows from the lower case passage (82*c*) to the radial direction transfer path (85*b*) and the axial direction transfer path (85*c*), and flows into the intake port (45*a*) of the shaft-inside oil supply path (45).

As shown in FIG. 1, the oil having flowed into the intake port (45*a*) of the shaft-inside oil supply path (45) goes up the main oil supply path (45*b*). Part of the oil is supplied to the lower bearing (71) through the lower outlet port (45*d*) to lubricate the sliding portion between the sliding bearing (71*a*) and the drive shaft (40). When the rest of the oil further goes up the main oil supply path (45*b*), part of that oil is supplied to the main bearing (37) through the upper outlet port (45*c*) to lubricate the sliding portion between the sliding bearing (37*a*) and the drive shaft (40). Thereafter, the oil flows out to the recess (36) in the housing (35) through the main bearing oil discharge path (35*a*). The rest of the oil further going up the main oil supply path (45*b*) flows into the oil communication chamber (48).

Part of the oil having flowed out to the oil communication chamber (48) flows into the oil path (56*a*), and the rest of the oil flows into the pin shaft passage. The oil having flowed into the oil path (56*a*) is supplied to the thrust surface between the fixed scroll (60) and the movable scroll (55), and a gap between the laps (57, 63). On the other hand, the oil having flowed into the pin shaft passage is supplied to the pin bearing (58) to lubricate the sliding portion between the sliding bearing (58*a*) and the drive shaft (40). Thereafter, the oil flows out to the recess (36) in the housing (35).

In the oil pump (81), the upper inner rotor (89) shown in FIG. 2 rotates inside the upper outer rotor (88) at this moment. The volume of the volume chamber (V2) is therefore increased and decreased, and the oil having flowed into the recess (36) is sucked into the shaft-inside oil discharge path (46) through the intake port (46*a*).

The oil having flowed into the shaft-inside oil discharge path (46) flows out to the recess (72) in the lower bearing member (70) which is located under the motor (30), and flows into the oil discharge pump (81*b*) of the oil pump (81). The oil having flowed into the oil discharge pump (81*b*) is sucked into the volume chamber (V2) in the upper case passage (82*b*), and then passes through the exhaust path (82*e*) of the pump case (82) to be discharged to the oil reservoir (26) at the bottom of the casing (20).

—Advantages of Embodiment—

In the present embodiment, the oil having supplied to the sliding portion of the pin bearing (58) and the main bearing (37) which is located above the motor (30) is sucked into the shaft-inside oil discharge path (46) by the oil supply pump (81*a*) of the oil pump (81), and thereafter, the oil is transferred to the area below the motor (30) through the shaft-inside oil discharge path (46), and is discharged to the oil reservoir (26). It is therefore not necessary to use the gap between the core cut in the motor (30) and the casing (20) in order to transfer the oil down to the area below the motor (30) and return the oil to the bottom of the casing (20). Thus, the core cut does not have to be large, and the cross-sectional area of the stator (31) does not have to be reduced, in order to keep the space for the oil return path. As a result, a reduction in motor efficiency can be prevented.

Further, in the present embodiment, oil is supplied from the oil reservoir (26) to the shaft-inside oil supply path (45) using the double oil pump (81), and the oil is discharged from the oil discharge path (90) to the oil reservoir (26). Due to this configuration, oil can be supplied and discharged with reliability, and the oil supply/discharge system can be reduced in size.

Further, in the present embodiment, the oil pump (81) is configured such that the capacity of the oil supply pump (81*a*) (i.e., the volume of the volume chamber (V1)) is larger than the capacity of the oil discharge pump (81*b*) (i.e., the volume of the volume chamber (V2)). Due to this configuration, an oil supply amount can be greater than an oil discharge amount. It is therefore possible to prevent a situation where oil is not properly supplied to the sliding portion of each of the bearings (i.e., the pin bearing (58), the main bearing (37), and the lower bearing (71)) and a refrigerant gas intervenes. As a result, it is possible to reduce a reduction in lubricity at the sliding portion.

In the present embodiment, the recess (72) in the lower bearing member (70) is used as an shaft-outside oil discharge path that communicates with the shaft-inside oil discharge path (46). Thus, under the motor (30), it is possible to supply oil using the shaft-inside oil supply path (45) that is located inside the drive shaft (40), and discharge oil using the shaft-outside oil discharge path that is located outside the drive shaft (40). Therefore, arrangements of the passages around the oil pump (81) can be easily achieved.

<Variation of First Embodiment>

The oil supply/discharge mechanism (80) of the above embodiment may have the configurations of the following variations.

—First Variation—

Figure 4:
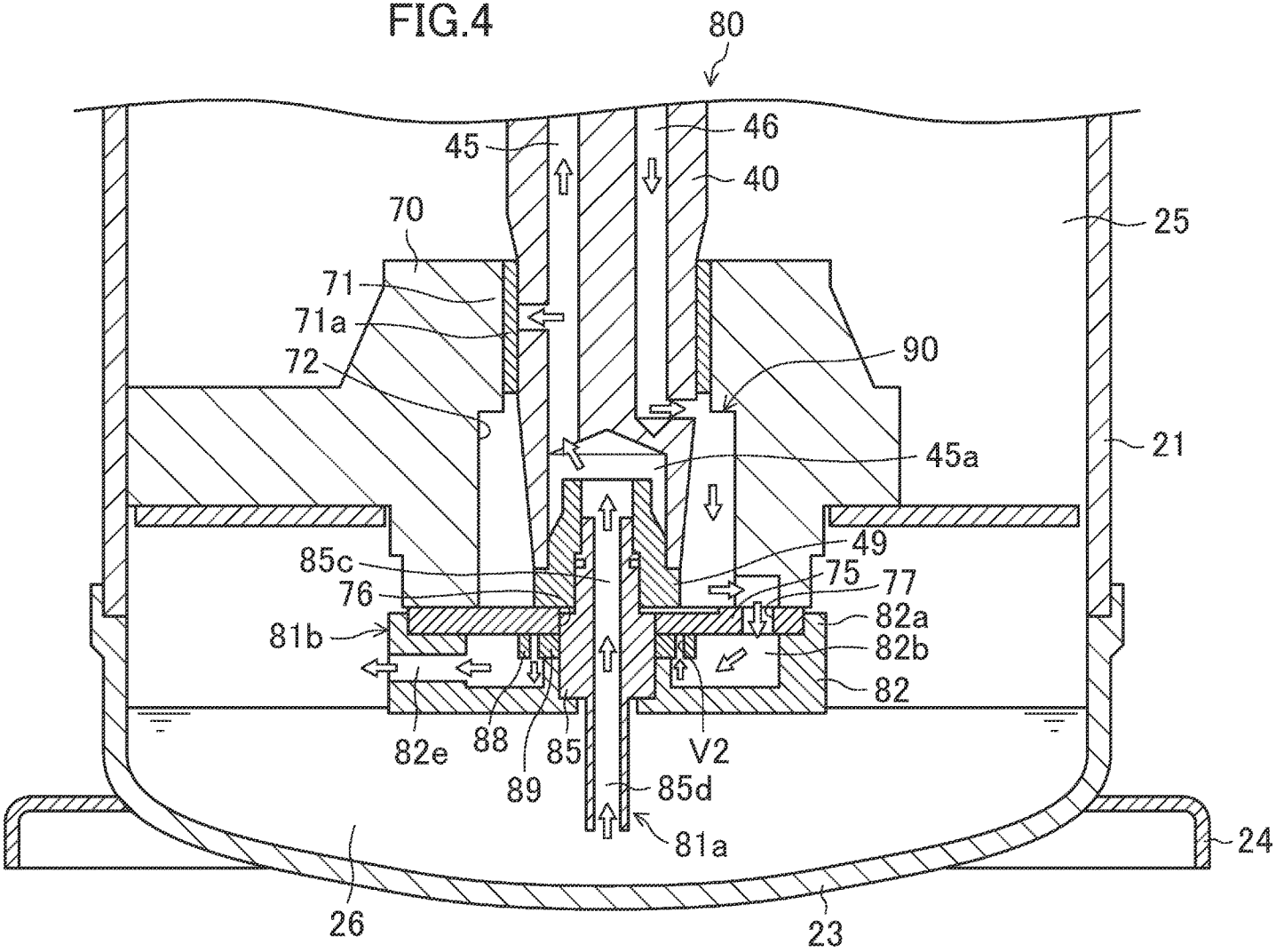
FIG. 4 is an enlarged view of an oil pump and its surroundings in a compressor of the first variation of the first embodiment.

A compressor (10) of the first variation differs from that of the first embodiment in the configuration of the oil supply pump (81*a*) of the oil pump (81). That is, the oil supply pump (81*a*) of the first embodiment is comprised of a positive displacement pump, whereas the oil supply pump (81*a*) of the first variation is comprised of a differential pressure pump as shown in FIG. 4.

Specifically, the oil pump (81) of the first variation is configured such that the lower case passage (82*c*) is not formed and only the upper case passage (82*b*) is formed in the pump case (82). Further, the pump shaft (85) coupled to the intake port (45*a*) of the drive shaft (40) by way of the cylindrical holding member (49) is extended downward, and is open to the oil reservoir (26). The pump shaft (85) includes an inlet passage (85*d*) which vertically penetrates the pump shaft (85).

In the oil supply pump (81*a*) of the first variation, oil in the oil reservoir (26) flows directly into the inlet passage (85*d*) of the pump shaft (85). The oil in the oil reservoir (26) is sucked into the pump shaft (85) at this moment by a pressure applied to the oil reservoir (26), i.e., a pressure difference between a pressure of the high-pressure space (25) and a pressure of the shaft-inside oil supply path (45), and is supplied to the shaft-inside oil supply path (45). On the other hand, similarly to the first embodiment, the oil in the oil discharge path (90) flows into the upper case passage (82*b*) of the oil discharge pump (81*b*) through the exhaust port (77) of the thrust plate (75), and is sucked into the volume chamber (V2) in the upper case passage (82*b*). The oil then passes through the exhaust path (82*e*) in the pump case (82), and flows out to the oil reservoir (26).

—Second Variation—

The oil supply pump (81*a*) of the oil pump (81) of the first embodiment may be comprised of a centrifugal pump.

—Third Variation—

Figure 5:
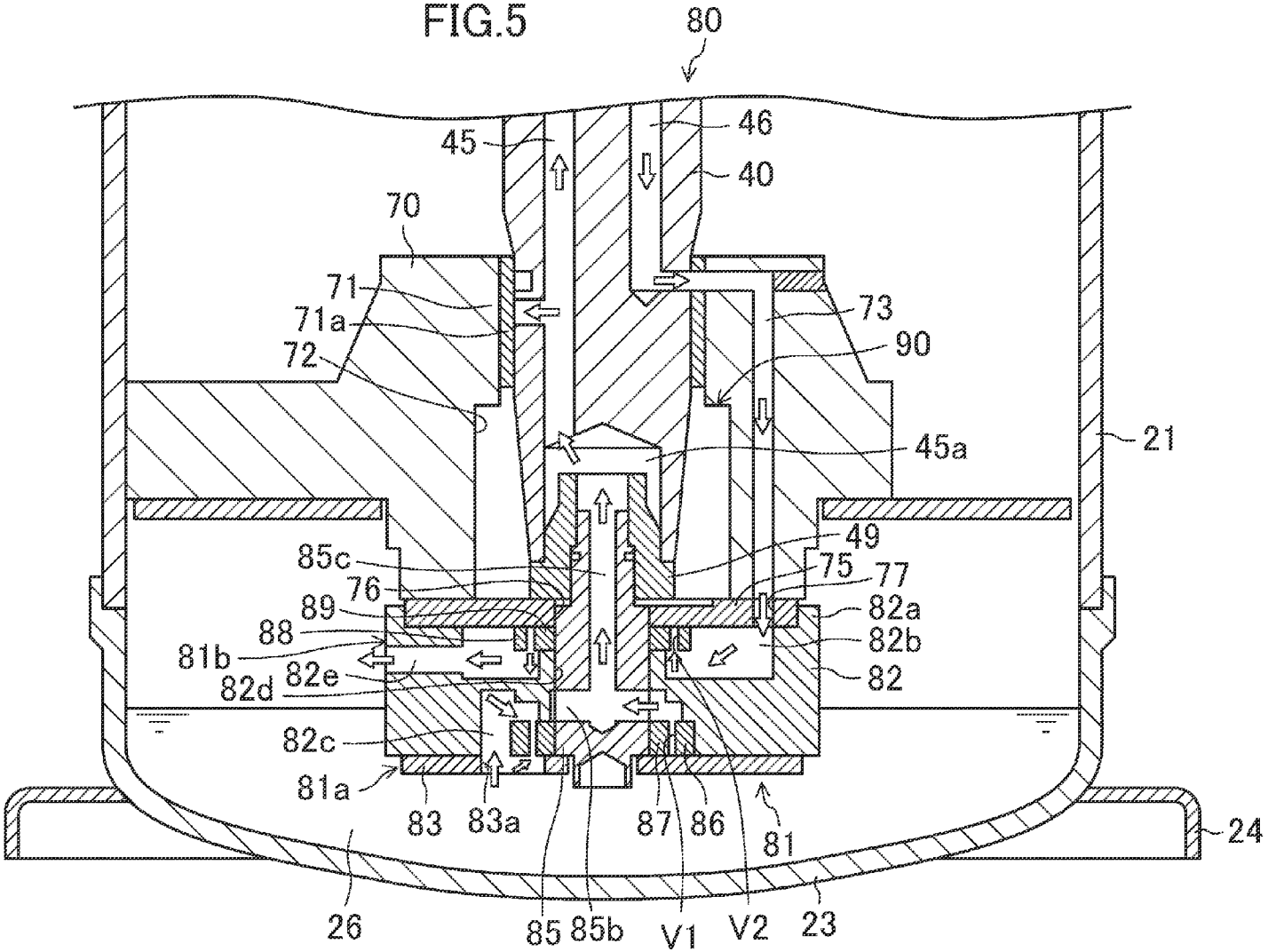
FIG. 5 is an enlarged view of an oil pump and its surroundings in a compressor of the third variation of the first embodiment.

In the first embodiment, the shaft-inside oil discharge path (46) is open to the recess (72) in the lower bearing member (70), and the oil in the shaft-inside oil discharge path (46) flows into the exhaust port (77) of the thrust plate (75) through the recess (72). That is, the shaft-outside oil discharge path is comprised of the recess (72) in the lower bearing member (70). However, the shaft-outside oil discharge path only needs to be formed in the lower bearing member (70). For example, as shown in FIG. 5, an exhaust path (73) open on the inner circumferential surface of the lower bearing (71) and communicating with the shaft-inside oil discharge path (46), and open on the lower surface of the lower bearing member (70) and communicating with the exhaust port (77) of the thrust plate (75) may be used as the shaft-outside oil discharge path.

<<Second Embodiment of Invention>>

Figure 6:
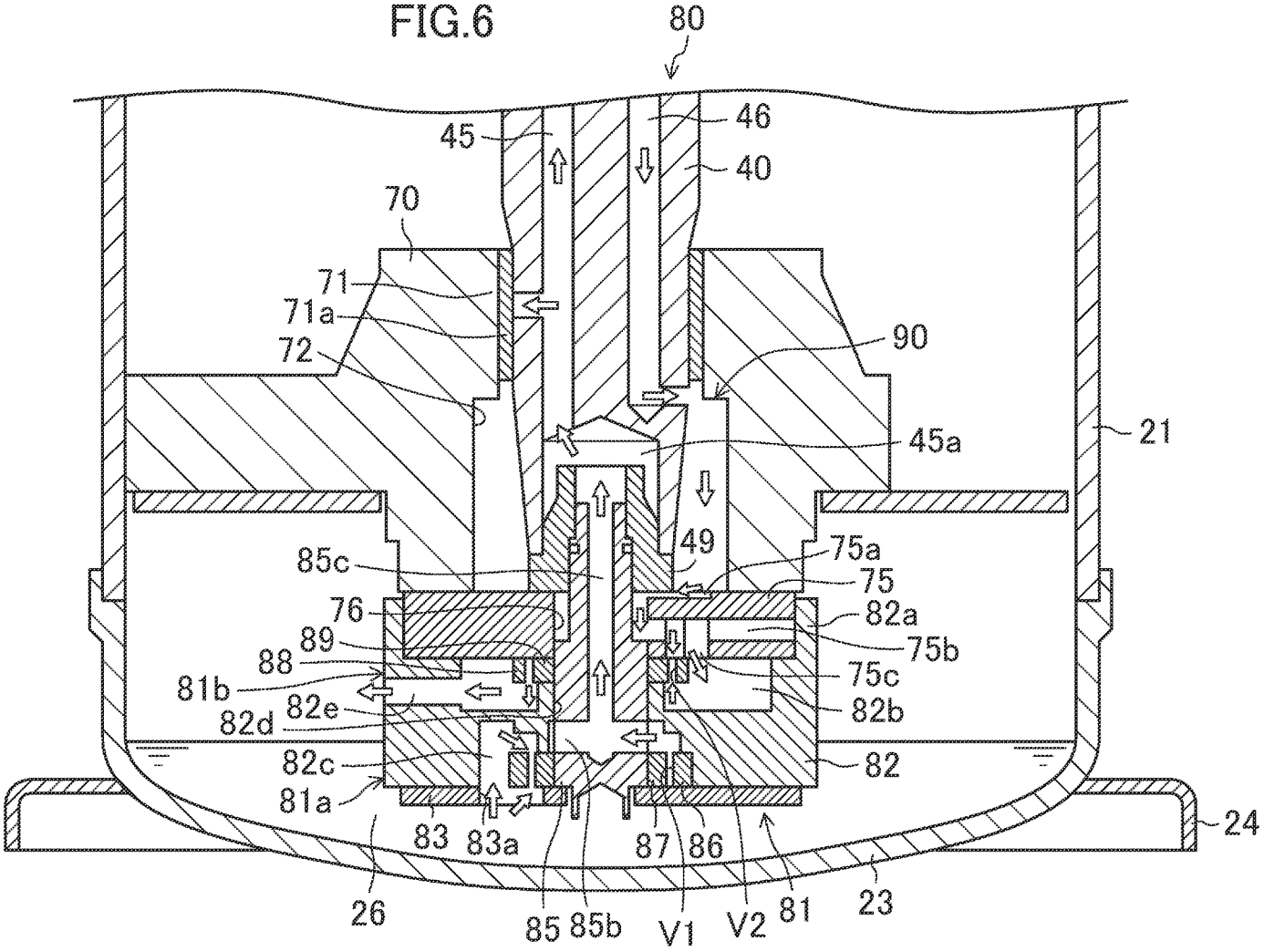
FIG. 6 is an enlarged view of an oil pump and its surroundings in a compressor of the second embodiment.

A compressor (10) of the second embodiment differs from that of the first embodiment in a method thr introducing oil from the oil discharge path (90) to the oil discharge pump (81*b*) of the oil pump (81). That is, oil is introduced through the exhaust port (77) formed at a peripheral portion of the thrust plate (75) in the first embodiment, whereas in the second embodiment, oil is introduced through the insertion hole (76) formed at a central portion of the thrust plate (75) as shown in FIG. 6.

Specifically, the thrust plate (75) of the second embodiment is provided with: a slit groove (75*a*) formed in its upper surface and extending in the radial direction, with its inner end communicating with the insertion hole (76); a lateral passage (75*b*) extending radially outward from a portion of the insertion hole (76); and an exhaust port (75*c*) extending downward from a portion of the lateral passage (75*b*) and being open to the lower surface of the thrust plate (75).

In the second embodiment, the oil having flowed out to the recess (72) in the lower bearing member (70), which is a lowermost part of the oil discharge path (90), flows along the slit groove (75*a*) in the upper surface of the thrust plate (75) and into the insertion hole (76), and sequentially flows through the lateral passage (75*b*) and the exhaust port (75*c*) and flows into the upper case passage (82*b*) of the oil discharge pump (81*b*). Thus, the oil is forced to flow to the thrust surface between the drive shaft (40) and the thrust plate (75), and as a result, it is possible to improve the lubricity of the thrust surface. The other configurations, effects and advantages are the same as those in the first embodiment.

<Variation of Second Embodiment>

The oil supply/discharge mechanism (80) of the above embodiment may have the configurations of the following variations.

—First Variation—

Figure 7:
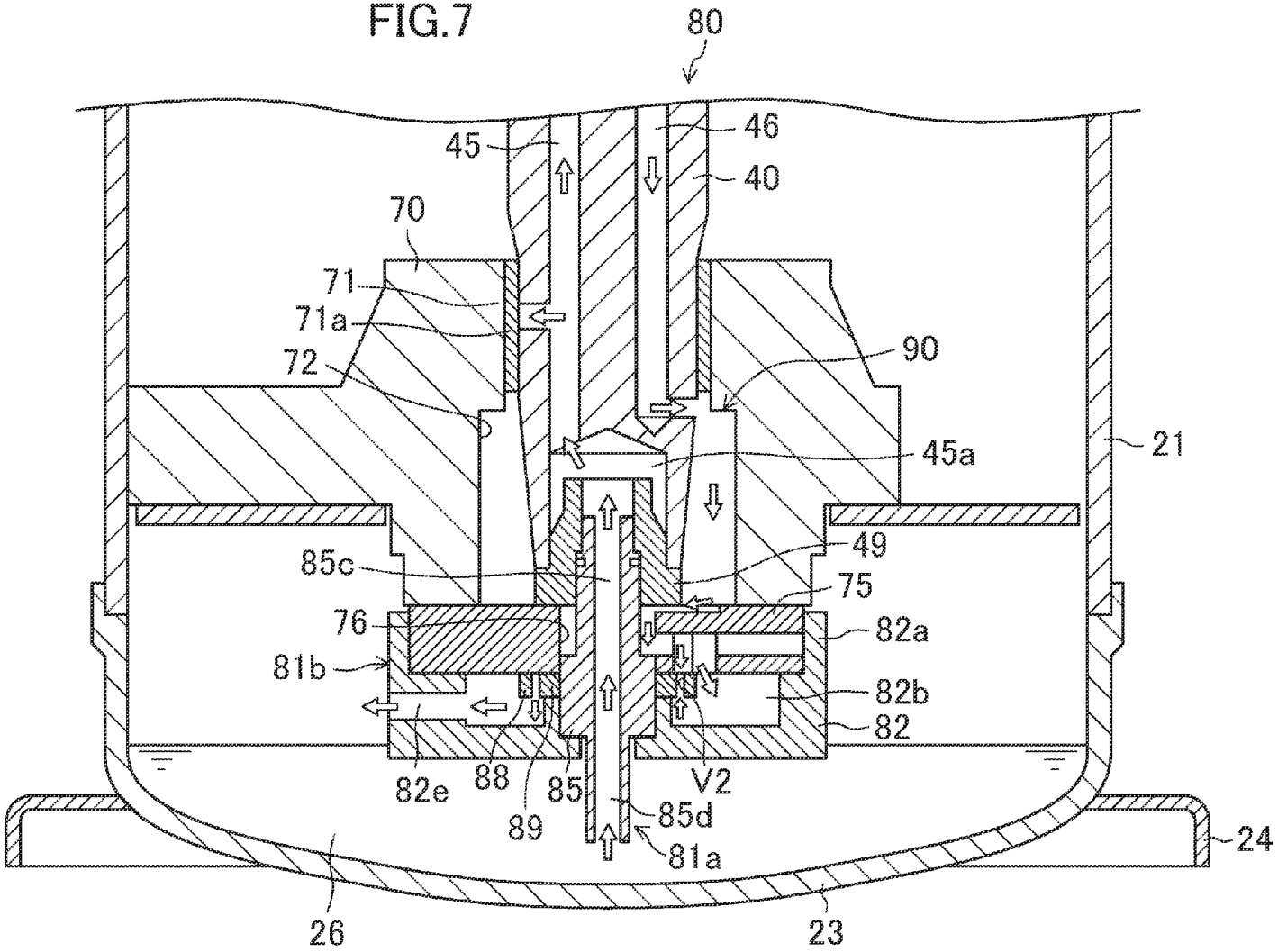
FIG. 7 is an enlarged view of an oil pump and its surroundings in a compressor of the first variation of the second embodiment.

A compressor (10) of the first variation differs from that of the second embodiment in the configuration of the oil supply pump (81*a*) of the oil pump (81). That is, the oil supply pump (81*a*) of the second embodiment is comprised of a positive displacement pump, whereas the oil supply pump (81*a*) of the first variation is comprised of a differential pressure pump as shown in FIG. 7.

Specifically, the oil pump (81) of the first variation is configured such that the lower case passage (82*c*) is not formed and only the upper case passage (82*b*) is formed in the pump case (82). Further, the pump shaft (85) coupled to the intake port (45*a*) of the drive shaft (40) by way of the cylindrical holding member (49) is extended downward, and is open to the oil reservoir (26). The pump shaft (85) includes an inlet passage (85*d*) which vertically penetrates the pump shaft (85).

In the oil supply pump (81*a*) of the first variation, oil in the oil reservoir (26) flows directly into the inlet passage (85*d*) of the pump shaft (85). The oil in the oil reservoir (26) is sucked into the pump shaft (85) by a pressure applied to the oil reservoir (26), i.e., a pressure difference between a pressure of the high-pressure space (25) and a pressure of the shaft-inside oil supply path (45), and is supplied to the shaft-inside oil supply path (45). On the other hand, similarly to the second embodiment, the oil in the oil discharge path (90) sequentially flows through the insertion hole (76), the lateral passage (75*b*), and the exhaust port (75*c*) of the thrust plate (75), and is sucked into the volume chamber (V2) in the upper case passage (82*b*) of the oil discharge pump (81*b*). Thereafter, the oil passes through the exhaust path (82*e*) of the pump case (82), and flows out to the oil reservoir (26).

—Second Variation—

The oil supply pump (81*a*) of the oil pump (81) of the second embodiment may be comprised of a centrifugal pump.

<<Third Embodiment of Invention>>

Figure 8:
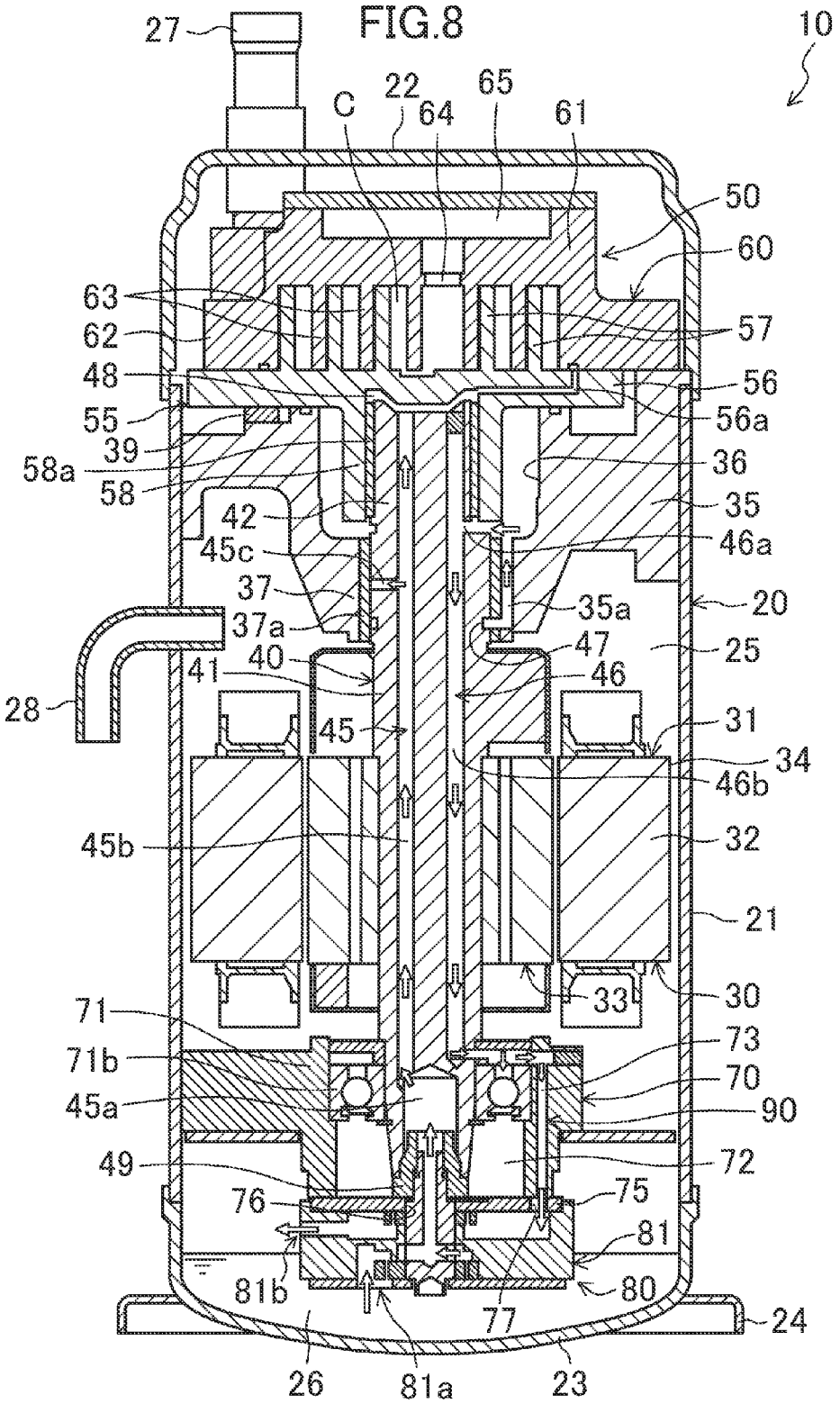
FIG. 8 is a longitudinal cross section of a compressor of the third embodiment.
Figure 9:
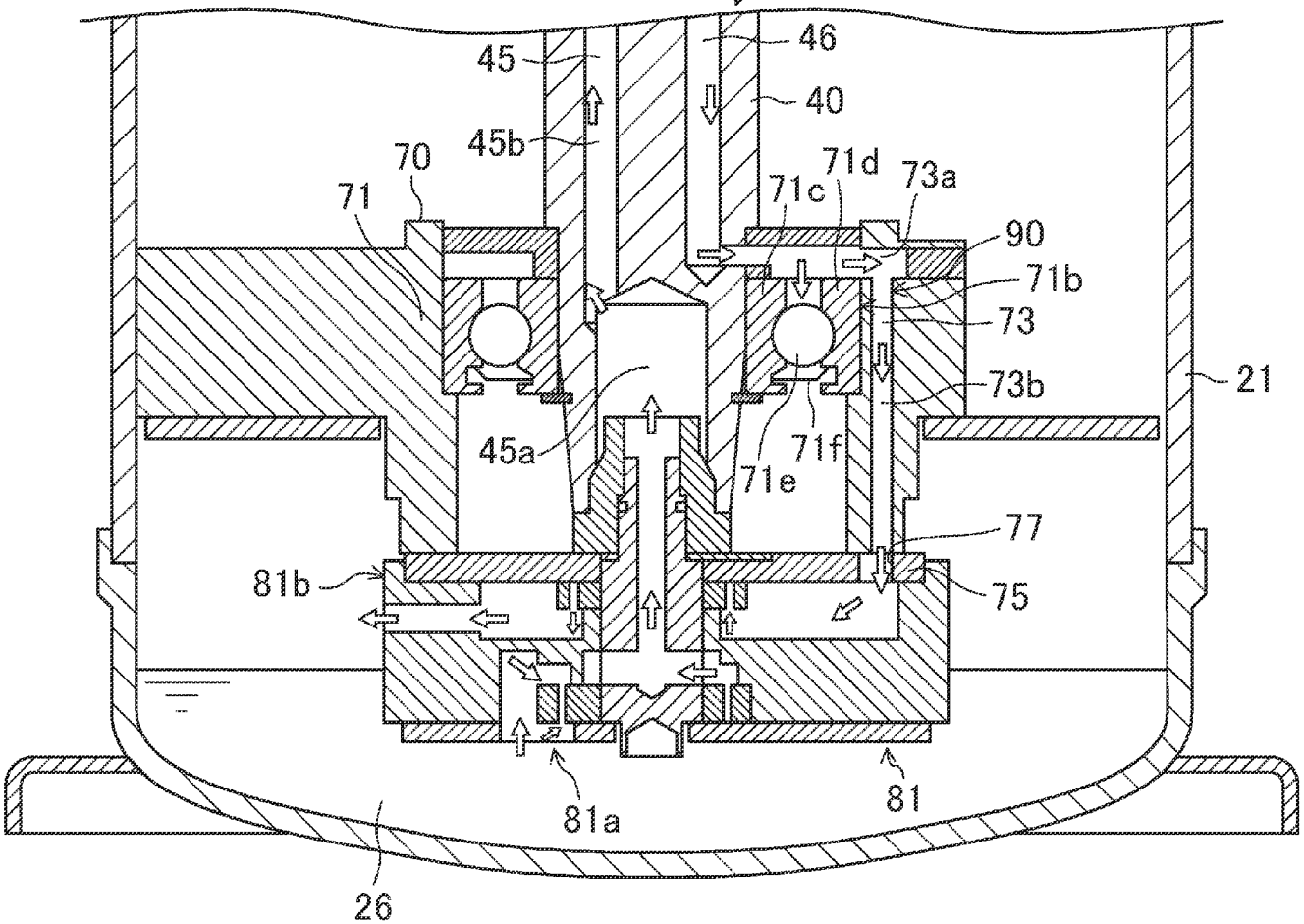
FIG. 9 is an enlarged view of an oil pump and its surroundings of the compressor of the third embodiment.

A compressor (10) of the third embodiment differs from that of the first embodiment in the type of the lower bearing (71), and the order of oil supply to the three bearings (i.e., the pin bearing (58), the main bearing (37), and the lower bearing (71)). That is, in the first embodiment, the sliding bearing (71*a*) is fitted in the lower bearing (71), and the oil is sequentially supplied to the lower bearing (71), the main bearing (37), and the pin bearing (58), whereas in the third embodiment, a roller bearing (71*b*) is fitted in the lower bearing (71), and the oil is sequentially supplied to the main bearing (37), the pin bearing (58), and the lower bearing (71) as shown in FIG. 8 and FIG. 9.

Specifically, the roller bearing (71*b*) of the third embodiment is a single sealed ball bearing, and includes an inner ring (71*c*), an outer ring (71*d*), a plurality of balls (71*e*), and a sealing portion (71*f*). The inner ring (71*c*) is fixed to an outer circumferential surface of the drive shaft (40). The outer ring (71*d*) is disposed radially outside the inner ring (71*c*) and faces the inner ring (71*c*). The balls (71*e*) are rotatably held between the inner ring (71*c*) and the outer ring (71*d*). In the roller bearing (71*b*), a sliding portion is formed between the inner ring (71*c*) and the balls (71*e*) or between the balls (71*e*) and the outer ring (71*d*). The sealing portion (71*f*) is a plate member located under the balls (71*e*) and extending from the outer ring (71*d*) to the inner ring (71*c*), and closes a gap between the outer ring (71*d*) and the inner ring (71*c*).

A shaft-inside oil supply path (45) of the third embodiment differs from the shaft inside oil supply path (45) of the first embodiment and the shaft-inside oil supply path (45) of the second embodiment in that the lower outlet port (45*d*) is not formed. Thus, the oil having flowed from the oil supply pump (81*a*) of the oil pump (81) to the intake port (45*a*) of the shaft-inside oil supply path (45) goes up the main oil supply path (45*b*) without being supplied to the roller bearing (71*b*) of the lower bearing (71).

An oil discharge path (90) of the third embodiment includes an exhaust path (73) as a shaft-outside oil discharge path. The exhaust path (73) is formed ed inside the lower bearing member (70), and includes an upper passage (73*a*) and a lower passage (73*b*).

The upper passage (73*a*) is formed in the lower bearing member (70) and above the roller bearing (71*b*) so as to extend in a radial direction. The inner end of the upper passage (73*a*) is open to the inner circumferential surface of the lower bearing (71) and communicates with the shaft-inside oil discharge path (46). Further, the upper passage (73*a*) communicates with a gap between the inner ring (71*c*) and the outer ring (71*d*) of the roller bearing (71*b*) located under the upper passage (73*a*).

The lower passage (73*b*) is formed in a peripheral portion of the lower bearing member (70) and extends vertically. The upper end of the lower passage (73*b*) communicates with the outer end of the upper passage (73*a*), and the lower end thereof is open to the lower surface of the lower bearing member (70) and communicates with the exhaust port (77) in the thrust plate (75).

In the third embodiment, the oil having flowed into the shaft-inside oil supply path (45) from the oil supply pump (81*a*) of the oil pump (81) goes up the main oil supply path (45*b*) without being supplied to the lower bearing (71), and is supplied to the main bearing (37) and the pin bearing (58). A sliding portion between the main bearing (37) and the pin bearing (58) is lubricated by the oil supplied.

After that, the oil supplied to the main bearing (37) and the pin bearing (58) flows into the shaft-inside oil discharge path (46) and goes down in the shaft-inside oil discharge path (46), and thereafter flows into the exhaust path (73). Then, part of the oil is supplied to the roller bearing (71*b*) of the lower bearing (71). In the roller bearing (71*b*), the oil flows into a gap between the inner ring (71*c*) and the outer ring (71*d*) and lubricates the sliding portion. On the other hand, the rest of the oil flows into the oil discharge pump (81*b*) of the oil pump (81), and is discharged to the oil reservoir (26) at the bottom of the casing (20).

As described above, in the third embodiment, the oil is sequentially supplied to the main bearing (37), the pin bearing (58), and the lower bearing (71). That is, the oil supply to the main bearing (37) and the pin bearing (58) is performed on the upstream side of the lower bearing (71). Thus, a sufficient amount of oil can be easily ensured and supplied to the upstream side main bearing (37) and the pin bearing (58), and as a result, it is possible to prevent shortage of oil supply, and abrasion and seizing. On the other hand, the amount of oil supplied to the downstream side lower bearing (71) can be easily reduced, and it is therefore possible to prevent an excess amount of oil from being supplied to the roller bearing (71*b*) which requires less oil than the sliding bearing. In other words, it is possible to supply an adequate mount of oil to the three bearings (37, 58, 71) and increase the reliability of the compressor (10). The other configurations, effects and advantages are the same as those of the first embodiment.

The foregoing embodiments are merely preferred examples in nature, and are not intended to limit the scope, applications, and use of the present invention.

Industrial Applicability

As described above, the present invention relates to compressors which compress a refrigerant, and is particularly useful as a compressor which includes, in a drive shaft, an oil supply path for supplying oil in an oil reservoir to a sliding portion above a motor.

What is claimed is:

1. A compressor comprising:

a casing, a motor fixed to the casing;

a drive shaft coupled to the motor, the drive shaft extending vertically;

a compression mechanism including a movable member and a fixed member which form a compression chamber therebetween, the compression mechanism being configured to be driven by the drive shaft and compress a fluid;

a shaft-inside oil supply path provided in the drive shaft, the shaft-inside oil supply path being configured such that oil at a bottom of the casing is supplied through the shaft-inside oil supply path to a sliding portion of the drive shaft above the motor; and an oil supply pump, the compressor including a shaft-inside oil discharge path provided in the drive shaft, the shaft-inside oil discharge path extending from an upper portion to a lower portion of the motor, and the oil supply pump being arranged and configured to supply the oil at the bottom of the casing to the shaft-inside oil supply path, an oil discharge pump coupled to a lower end of the drive shaft, the oil discharge pump being arranged and configured to discharge the oil that has been supplied to the sliding portion of the drive shaft to the bottom of the casing through the shaft-inside oil discharge path, and a lower bearing member rotatably supporting a portion of the drive shaft lower than the motor, the oil discharge pump being fixed to the lower bearing member, and the oil supply pump forming a double pump with the oil discharge pump.

2. The compressor of claim 1, wherein the oil supply pump has a capacity that is larger than a capacity of the oil discharge pump.

3. The compressor of claim 2, further comprising shaft-outside oil discharge paths formed in the lower bearing member, the shaft-outside oil discharge paths communicating with an outlet end of the shaft-inside oil discharge path and a suction port of the oil discharge pump.

4. The compressor of claim 1, further comprising shaft-outside oil discharge paths formed in the lower head rig member, the shaft outside oil discharge paths communicating with an outlet end of the shaft-inside oil discharge path and a suction port of the oil discharge pump.

* * * * *